US012329260B2

(12) United States Patent
Billingslea

(10) Patent No.: US 12,329,260 B2
(45) Date of Patent: Jun. 17, 2025

(54) DREADLOCK CURLING DEVICE

(71) Applicant: Nicole Billingslea, Portsmouth, VA (US)

(72) Inventor: Nicole Billingslea, Portsmouth, VA (US)

( * ) Notice: Subject to any disclaimer, the term of this patent is extended or adjusted under 35 U.S.C. 154(b) by 498 days.

(21) Appl. No.: 17/965,407

(22) Filed: Oct. 13, 2022

(65) Prior Publication Data

US 2024/0122324 A1 Apr. 18, 2024

(51) Int. Cl.
*A45D 2/36* (2006.01)

(52) U.S. Cl.
CPC ..... *A45D 2/367* (2013.01)

(58) Field of Classification Search
CPC ... A45D 1/00; A45D 1/02; A45D 1/04; A45D 1/06; A45D 1/10; A45D 1/12; A45D 1/16; A45D 1/28; A45D 2/00; A45D 2/367; A45D 6/02; A45D 6/04; A45D 20/48; A45D 20/50; A45D 20/52
See application file for complete search history.

(56) References Cited

U.S. PATENT DOCUMENTS

| | | | |
|---|---|---|---|
| 3,990,460 | A | 11/1976 | Shalvoy |
| 4,442,849 | A | 4/1984 | Kawabe |
| 4,829,156 | A | 5/1989 | Thompson |
| 6,708,699 | B2 | 3/2004 | McGriff, III |
| 7,045,744 | B2 | 5/2006 | Oh |
| D547,903 | S | 7/2007 | Rizzuto |
| 10,660,417 | B2 | 5/2020 | Bennett |

FOREIGN PATENT DOCUMENTS

| | | |
|---|---|---|
| EP | 1472951 | 4/2004 |

*Primary Examiner* — Rachel R Steitz
*Assistant Examiner* — Karim Asqiriba

(57) ABSTRACT

A dreadlock curling device for curling a dreadlock includes a handle with a rotating curling member extending from a first end of the handle. The curling member is configured for being wrapped by a dreadlock and selectively rotating to curl the dreadlock. A hair clip attached to the curling member secures and end of the dreadlock to the curling member. A motor selectively rotates the curling member. And a drying coil selectively heats the curling member, thereby drying the dreadlock when it is wrapped around the curling member.

16 Claims, 4 Drawing Sheets

DREADLOCK CURLING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to hair curling devices and more particularly pertains to a new hair curling device for curling dreadlocked hair.

(2) Description of Related Art Including Information Disclosed Under 37 CFR 1.97 and 1.98

The prior art relates to hair curling devices which form curls or waves in hair. Some of these devices automatically rotate the curling implement and many also use heat to dry the hair into the curled formation. However, the prior art does not disclose a device which clips the end of a dreadlock onto a rotating element while heating the element to curl the dreadlock.

BRIEF SUMMARY OF THE INVENTION

An embodiment of the disclosure meets the needs presented above by generally comprising a handle having a first end and a second end and defining an interior space. A curling member extends from the first end of the handle, and the curling member is rotationally coupled to the handle. The curling member has a proximal end relative to the handle and a distal end relative to the handle. The curling member has an outer wall with an outer surface. The outer wall defines a hollow space, and the curling member is configured for being wrapped by a dreadlock. The curling member is configured for selectively rotating to curl the dreadlock. A hair clip is coupled to the outer surface of the outer wall of the curling member and defines a notch which extends away from the handle. The hair clip is configured for containing an end of the dreadlock within the notch, thereby securing the end of the dreadlock to the curling member. A motor is operationally coupled to the curling member such that the motor selectively rotates the curling member relative to the handle. The motor is also positioned within the interior space A drying coil is positioned within the hollow space and is configured for selectively converting an electrical power into a drying coil heat, thereby drying the dreadlock when the dreadlock is wrapped around the curling member.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
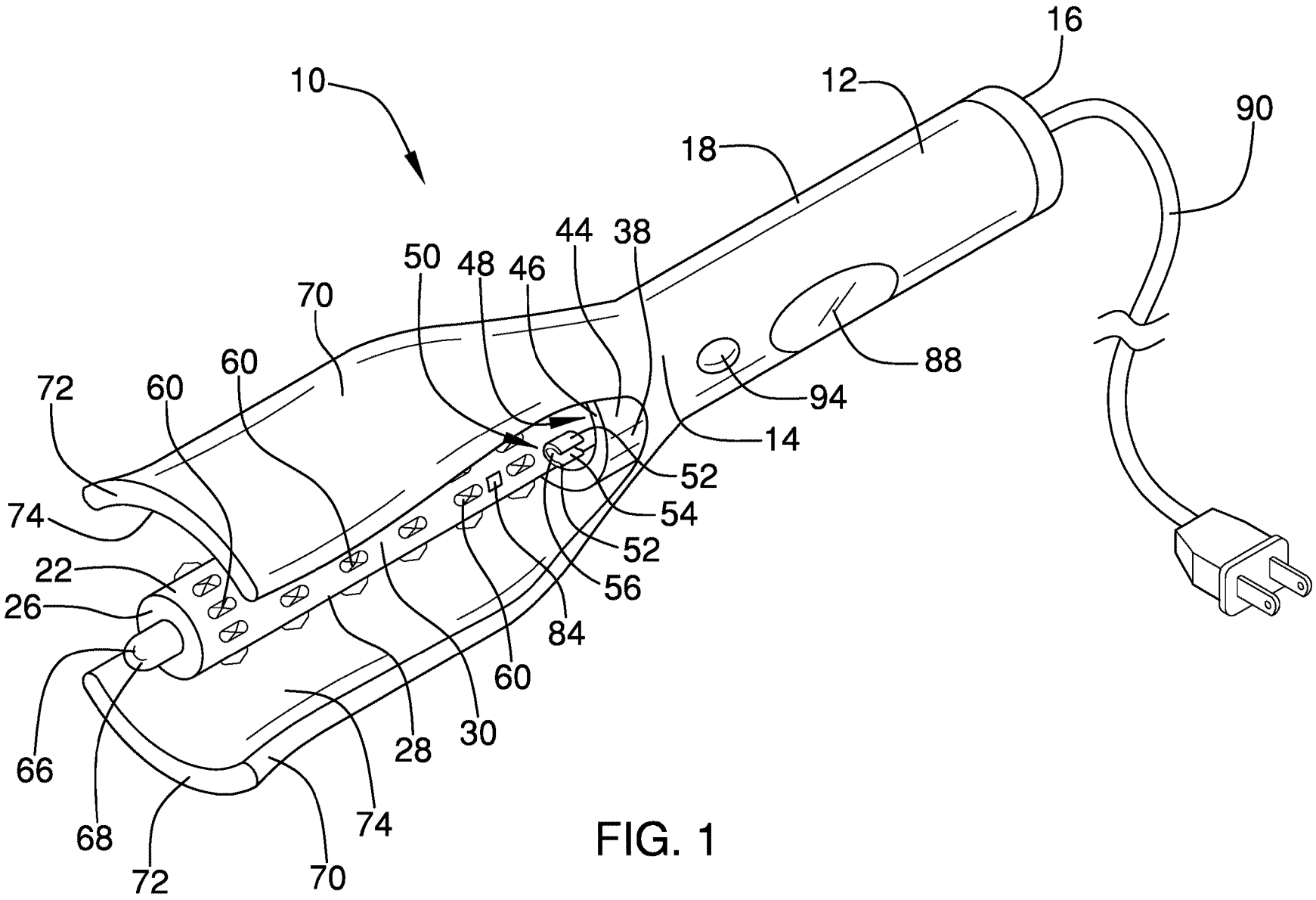
FIG. 1 is a top front side perspective view of a dreadlock curling device according to an embodiment of the disclosure.
Figure 2:
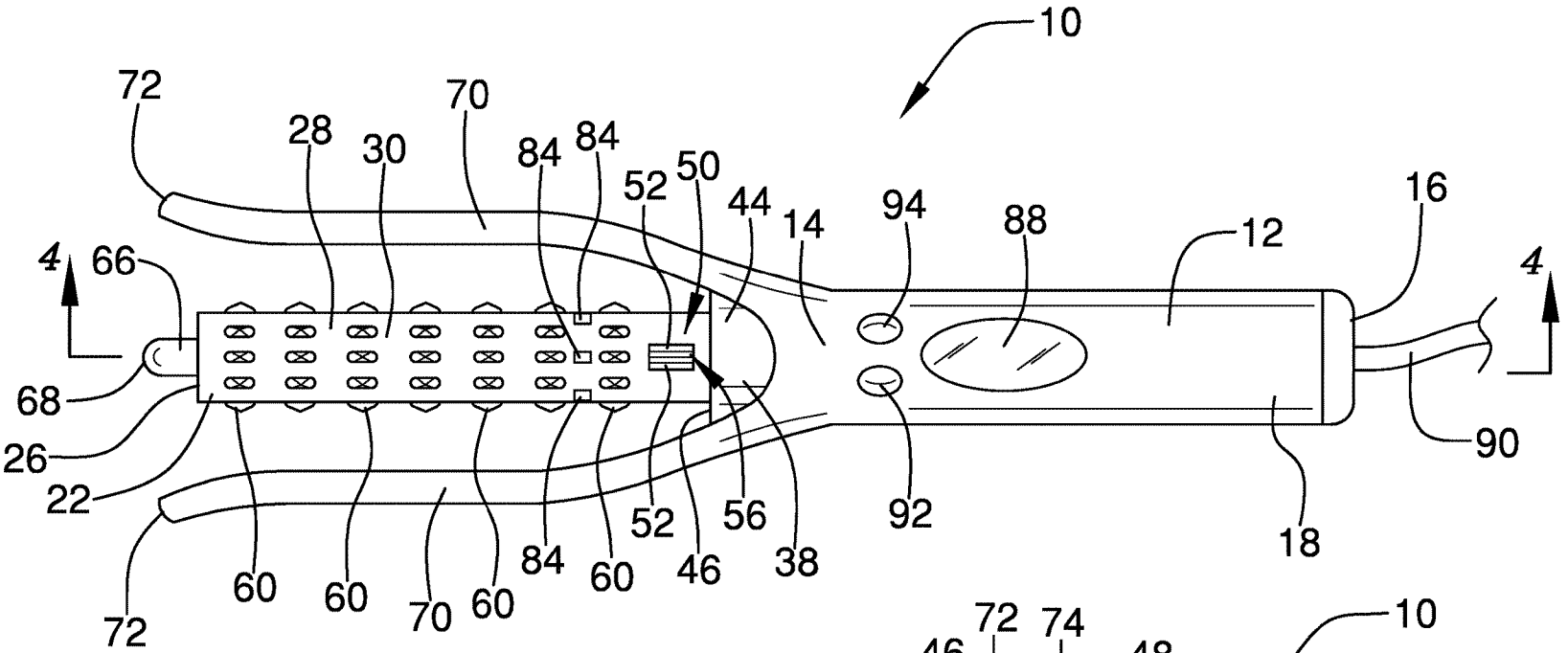
FIG. 2 is a side view of an embodiment of the disclosure.
Figure 3:
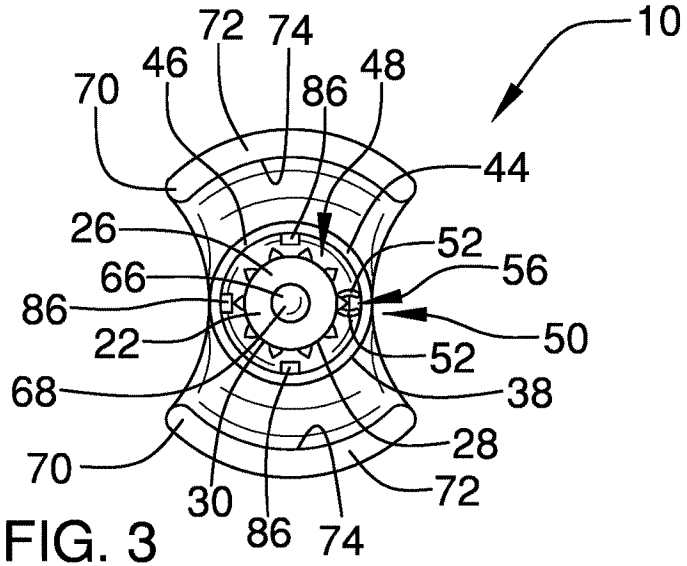
FIG. 3 is a front view of an embodiment of the disclosure.
Figure 4:
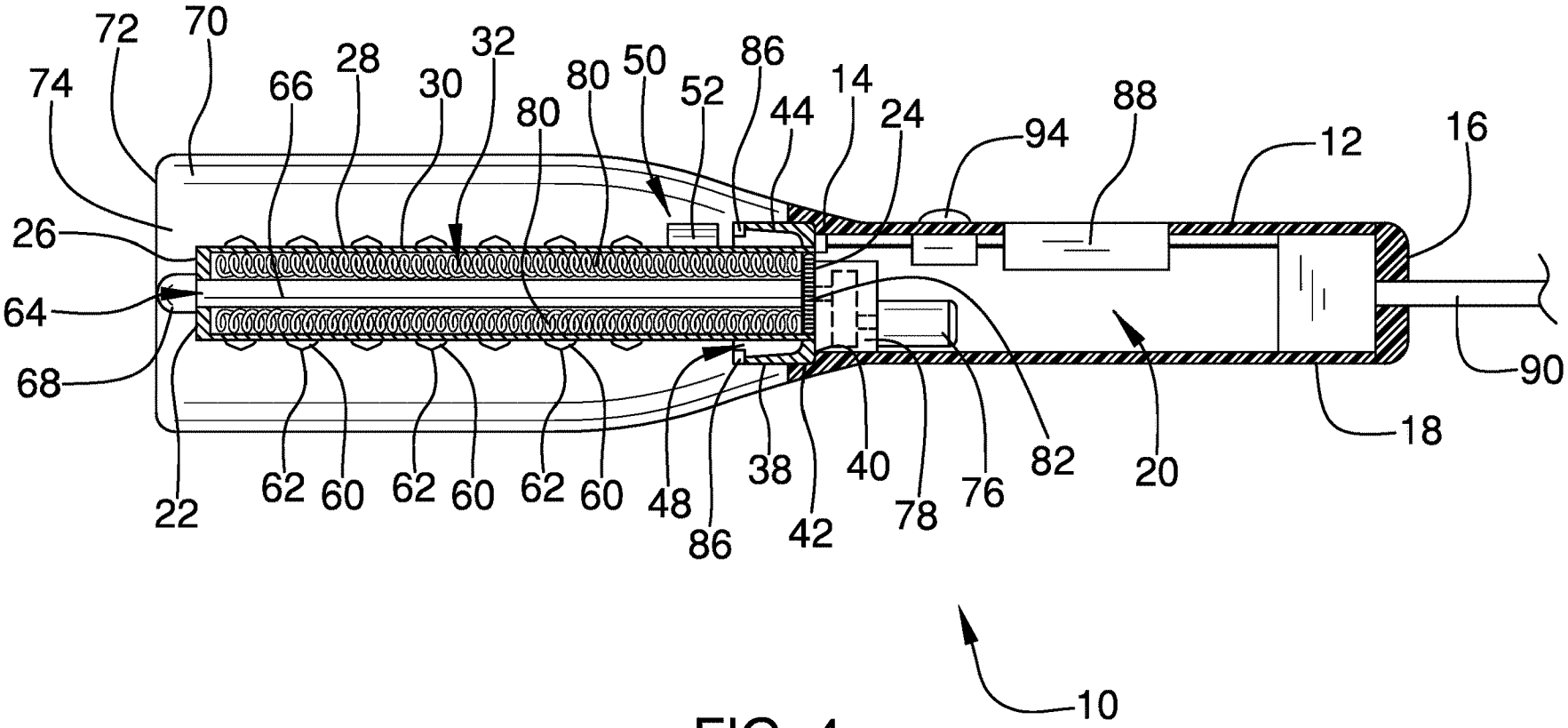
FIG. 4 is a cross-sectional view of an embodiment of the disclosure from the arrows 4-4 in FIG. 2.
Figure 5:
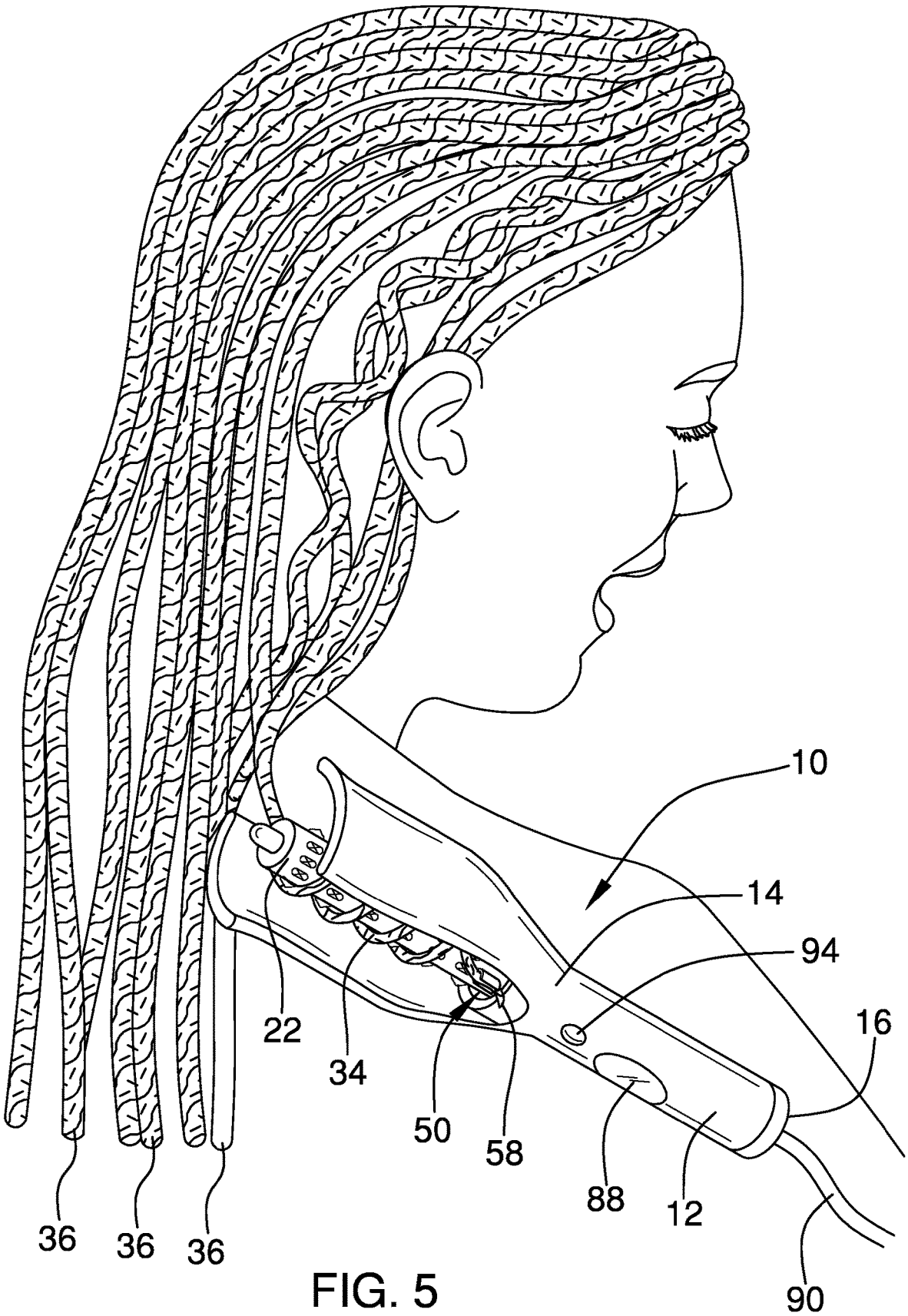
FIG. 5 is an in-use view of an embodiment of the disclosure.

With reference now to the drawings, and in particular to FIGS. 1 through 5 thereof, a new hair curling device embodying the principles and concepts of an embodiment of the disclosure and generally designated by the reference numeral 10 will be described.

As best illustrated in FIGS. 1 through 5, the dreadlock curling device 10 generally comprises a handle 12, wherein the handle 12 has a first end 14, a second end 16, and an outer surface 18 that is cylindrical. The handle 12 also defines an interior space 20. A curling member 22 extends from the first end 14 of the handle 12 and is rotationally coupled to the handle 12. The curling member 22 has a proximal end 24 relative to the handle 12 and a distal end 26 relative to the handle 12. The curling member 22 also has an outer wall 28, which has an outer surface 30 that is cylindrical. The outer wall 28 defines a hollow space 32. The curling member 22 is configured for being wrapped by a dreadlock 36 and for selectively rotating to curl the dreadlock 36.

A moisture reservoir 38 has a base portion 40 extending from the outer surface 30 of the outer wall 28 of the curling member 22 at the proximal end 24 of the curling member 22. The moisture reservoir 38 has a perimeter wall portion 44 that is cylindrical and which is coupled to a perimeter edge 42 of the base portion 40 of the moisture reservoir 38 and extends away from the handle 12. The perimeter wall portion 44 has a distal end 46 relative to the base portion 40. The moisture reservoir 38 defines a cavity 48 between the curling member 22 and the moisture reservoir 38 which is configured for containing a quantity of water within the cavity 48.

A hair clip 50 is coupled to the outer surface 30 of the outer wall 28 of the curling member 22 proximate the moisture reservoir 38. The hair clip 50 has a pair of clip portions 52 which each extend away from the curling member 22. Each clip portion 52 has a concave surface 54 facing the other clip portion 52. The hair clip 50 defines a notch 56 between the pair of clip portions 52 which extends away from the handle 12. The hair clip 50 is configured for containing an end 58 of the dreadlock 36 within the notch 56, thereby securing the end 58 of the dreadlock 36 to the curling member 22.

A plurality of grips 60 is positioned across the outer surface 30 of the outer wall 28 of the curling member 22. Each grip 60 extends from the curling member 22 and tapers away from the curling member 22 to an associated point 62. Each grip 60 is constructed of a flexible and resilient material. Each grip 60 is configured for pulling the dreadlock 36 when the dreadlock 36 is wrapped around the curling member 22 and the curling member 22 rotates, thereby facilitating the curling of the dreadlock 36.

An aperture 64 extends through the distal end 26 of the curling member 22 to the hollow space 32. A rod 66 is rotationally coupled to the handle 12 and extends through the aperture 64 and the hollow space 32. The rod 66 has a cap portion 68 which is positioned in abutment with the curling member 22 at the distal end 26 of the curling member 22, thereby securing the curling member 22 to the rod 66. A pair of shrouds 70 is coupled to and extends from the first end 14 of the handle 12, each shroud 70 having a distal end 72 relative to the handle 12. Each shroud 70 diverges from each other shroud 70 from the handle 12 to the distal end 72 of each shroud 70. Each shroud 70 has a concave surface 74 which faces the curling member 22.

A motor 76 is operationally coupled to the rod 66 such that the motor 76 selectively rotates the rod 66 relative to the handle 12. The motor 76 is positioned within the interior space 20. A gear box 78 is positioned within the interior space 20 and between the motor 76 and the rod 66. The gear box 78 operationally coupling the motor 76 to the rod 66.

Each of a pair of drying coils 80 is positioned between the rod 66 and the curling member 22. The pair of drying coils 80 is configured for selectively converting an electrical power into a drying coil heat, thereby drying the dreadlock 36 when the dreadlock 36 is wrapped around the curling member 22. A vaporizing coil 82 is positioned within the hollow space 32 along the outer wall 28 of the curling member 22 at the proximal end 24 of the curling member 22. The vaporizing coil 82 is configured for selectively converting the electrical power into a vaporizing coil heat, thereby vaporizing the quantity of water within the cavity 48.

A plurality of hair moisture sensors 84 is positioned around the outer surface 30 of the outer wall 28 of the curling member 22. Each hair moisture sensor 84 is configured for sensing a presence of a quantity of moisture in the dreadlock 36 when the dreadlock 36 is wrapped around the curling member 22. A plurality of reservoir moisture sensors 86 is positioned around the distal end 46 of the perimeter wall portion 44 of the moisture reservoir 38. Each reservoir moisture sensor 86 is configured for sensing a presence of a quantity of moisture at the distal end 46 of the perimeter wall portion 44 of the moisture reservoir 38. The plurality of reservoir moisture sensors 86 is operationally coupled to each of the motor 76, the pair of drying coils 80, and the vaporizing coil 82 and is configured for deactivating each of the motor 76, the pair of drying coils 80, and the vaporizing coil 82 when the plurality of reservoir moisture sensors 86 senses the presence of the quantity of moisture.

A light signal emitter 88 is positioned partially within the interior space 20 and coupled to the handle 12. The light signal emitter 88 is operationally coupled to the plurality of hair moisture sensors 84. The light signal emitter 88 is configured for generating a wet light signal when the plurality of hair moisture sensors 84 senses the presence of the quantity of moisture and for generating a dry light signal when the plurality of hair moisture sensors 84 does not sense the presence of the quantity of moisture. The light signal emitter 88 is also operationally coupled to the plurality of reservoir moisture sensors 86, the light signal emitter 88 is configured for generating a full reservoir light signal when the plurality of reservoir moisture sensors 86 senses the presence of the quantity of moisture.

A power cord 90 is coupled to and extends from the second end 16 of the handle 12. The power cord 90 is electrically coupled to each of the plurality of hair moisture sensors 84, the plurality of reservoir moisture sensors 86, and the light signal emitter 88 and is selectively electrically couplable to each of the motor 76, the pair of drying coils 80, and the vaporizing coil 82. The power cord 90 is configured for electrically coupling to an electrical power source.

A curling control button 92 is positioned on and coupled to the outer surface 18 of the handle 12 and is operationally coupled to the motor 76. The curling control button 92 is depressible and electrically couples the motor 76 to the power cord 90 when depressed, thereby activating the motor 76. A heating control button 94 is positioned on and coupled to the outer surface 18 of the handle 12 proximate the curling control button 92. The heating control button 94 is operationally coupled to each of the pair of drying coils 80 and the vaporizing coil 82. The heating control button 94 is depressible and electrically couples each of the pair of drying coils 80 and the vaporizing coil 82 to the power cord 90 when depressed, thereby activating each of the pair of drying coils 80 and the vaporizing coil 82.

In use, the dreadlock 36 is wetted and the end 58 of the dreadlock 36 is clipped into the hair clip 50. The power cord 90 is coupled to the electrical power source. The plurality of hair moisture sensors 84 detects the presence of the quantity of moisture in the dreadlock 36, triggering the light signal emitter 88 to generate the wet light signal indicating that the hair is ready to curl. The curling control button 92 is depressed to rotate the curling member 22, which pulls the dreadlock 36 to wrap the dreadlock 36 around the curling member 22. The heating control button 94 is depressed to activate the pair of drying coils 80 and the vaporizing coil 82. The hair dries, and the quantity of water travels down the curling member 22 to the cavity 48 defined by the moisture reservoir 38, where it is vaporized by the heat from the vaporizing coil 82.

If the quantity of water does not vaporize quickly enough before the moisture reservoir 38 fills, the plurality of reservoir moisture sensors 86 senses the presence of the quantity of water at the distal end 46 of the perimeter wall 44 of the moisture reservoir 38. Then the plurality of reservoir moisture sensors 86 triggers the light signal emitter 88 to generate the full reservoir light signal and the motor 76, pair of drying coils 80, and vaporizing coil 82 deactivate. Otherwise, the light signal emitter 88 will generate a dry light signal when the plurality of hair moisture sensors 84 does not sense the presence of the quantity of moisture, indicating that the dreadlock 36 is done being curled.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A dreadlock curling device comprising:

a handle, said handle having a first end and a second end, said handle defining an interior space;

a curling member, said curling member extending from said first end of said handle, said curling member being rotationally coupled to said handle, said curling member having a proximal end relative to said handle and a distal end relative to said handle, said curling member having an outer wall, said outer wall having an outer surface, said outer wall defining a hollow space, said curling member being configured for being wrapped by a dreadlock, said curling member being configured for selectively rotating to curl the dreadlock;

a hair clip, said hair clip being coupled to said outer surface of said outer wall of said curling member, said hair clip defining a notch, said notch extending away from said handle, said hair clip being configured for containing an end of the dreadlock within said notch, thereby securing the end of the dreadlock to the curling member;

a motor, said motor being operationally coupled to said curling member such that said motor selectively rotates said curling member relative to said handle, said motor being positioned within said interior space;

a drying coil, said drying coil being positioned within said hollow space, said drying coil being configured for selectively converting an electrical power into a drying coil heat, thereby drying the dreadlock when the dreadlock is wrapped around said curling member;

an aperture, said aperture extending through said distal end of said curling member to said hollow space;

a rod, said rod being rotationally coupled to said handle, said rod extending through said aperture and said hollow space, said rod having a cap portion, said cap portion being positioned in abutment with said curling member at said distal end of said curling member, thereby securing said curling member to said rod, said motor being operationally coupled to said rod such that said motor selectively rotates said rod relative to said handle; and further comprising said hair clip having a pair of clip portions, each clip portion extending away from said curling member, each clip portion having a concave surface facing another clip portion, said hair clip defining a notch between said pair of clip portions.

2. The device of claim 1, further comprising a moisture reservoir, said moisture reservoir having a base portion extending from said outer surface of said outer wall of said curling member at said proximal end of said curling member, said moisture reservoir having a perimeter wall portion being coupled to a perimeter edge of said base portion of said moisture reservoir and extending away from said handle, said perimeter wall portion having a distal end relative to said base portion, said moisture reservoir defining a cavity between said curling member and said moisture reservoir, said moisture reservoir being configured for containing a quantity of water within said cavity.

3. The device of claim 2, further comprising a vaporizing coil, said vaporizing coil being positioned within said hollow space along said outer wall of said curling member at said proximal end of said curling member, said vaporizing coil being configured for selectively converting the electrical power into a vaporizing coil heat, thereby vaporizing the quantity of water within said cavity.

4. The device of claim 3, further comprising a reservoir moisture sensor, said reservoir moisture sensor being positioned on said distal end of said perimeter wall portion of said moisture reservoir, said reservoir moisture sensor being configured for sensing a presence of a quantity of moisture at said distal end of said perimeter wall portion of said moisture reservoir, said reservoir moisture sensor being operationally coupled to each of said motor, said drying coil, and said vaporizing coil, said reservoir moisture sensor being configured for deactivating each of said motor, said drying coil, and said vaporizing coil when said reservoir moisture sensor senses the presence of the quantity of moisture.

5. The device of claim 4, further comprising a heating control button, said heating control button being positioned on and coupled to said handle, said heating control button being operationally coupled to each of said drying coil and said vaporizing coil, said heating control button being depressible, said heating control button activating each of said drying coil and said vaporizing coil when depressed.

6. The device of claim 4, further comprising a light signal emitter, said light signal emitter being positioned partially within said interior space and coupled to said handle, said light signal emitter being operationally coupled to said reservoir moisture sensor, said light signal emitter being configured for generating a full reservoir light signal when said reservoir moisture sensor senses the presence of the quantity of moisture.

7. The device of claim 1, further comprising a hair moisture sensor, said hair moisture sensor being positioned on said outer surface of said outer wall of said curling member, said hair moisture sensor being configured for sensing a presence of a quantity of moisture in the dreadlock when the dreadlock is wrapped around the curling member.

8. The device of claim 7, further comprising a light signal emitter, said light signal emitter being positioned partially within said interior space and coupled to said handle, said light signal emitter being operationally coupled to said hair moisture sensor, said light signal emitter being configured for generating a wet light signal when said plurality of hair moisture sensors sense the presence of the quantity of moisture, said light signal emitter being configured for generating a dry light signal when said plurality of hair moisture sensors do not sense the presence of the quantity of moisture.

9. The device of claim 1, further comprising a curling control button, said curling control button being positioned on and coupled to said handle, said curling control button being operationally coupled to said motor, said curling control button being depressible, said curling control button activating said motor when depressed.

10. The device of claim 1, further comprising a plurality of grips, said plurality of grips being positioned across said outer surface of said outer wall of said curling member, each said grip extending from said curling member, each said grip being configured for pulling the dreadlock when the dreadlock is wrapped around the curling member and said curling member rotates, thereby facilitating the curling of the dreadlock.

11. The device of claim 10, further comprising each said grip tapering away from said curling member to an associated point.

12. The device of claim 10, further comprising each said grip being constructed of a flexible and resilient material.

13. The device of claim 12, further comprising each said grip being constructed of rubber.

14. The device of claim 1, further comprising a pair of shrouds, said pair of shrouds being coupled to and extending from said first end of said handle, each said shroud having a distal end relative to said handle, each said shroud diverging from each other shroud from said handle to said distal end of each said shroud.

15. The device of claim 14, further comprising each said shroud having a concave surface, said concave surface of each said shroud facing said curling member.

16. A dreadlock curling device comprising:

a handle, said handle having a first end and a second end, said handle having an outer surface, said handle defining an interior space, said outer surface of said handle being cylindrical;

a curling member, said curling member extending from said first end of said handle, said curling member being rotationally coupled to said handle, said curling member having a proximal end relative to said handle and a distal end relative to said handle, said curling member having an outer wall, said outer wall having an outer surface, said outer surface of said outer wall being cylindrical, said outer wall defining a hollow space, said curling member being configured for being wrapped by a dreadlock, said curling member being configured for selectively rotating to curl the dreadlock;

a moisture reservoir, said moisture reservoir having a base portion extending from said outer surface of said outer wall of said curling member at said proximal end of said curling member, said moisture reservoir having a perimeter wall portion being coupled to a perimeter edge of said base portion of said moisture reservoir and extending away from said handle, said perimeter wall portion having a distal end relative to said base portion, said perimeter wall portion being cylindrical, said moisture reservoir defining a cavity between said curling member and said moisture reservoir, said moisture reservoir being configured for containing a quantity of water within said cavity;

a hair clip, said hair clip being coupled to said outer surface of said outer wall of said curling member proximate said moisture reservoir, said hair clip having a pair of clip portions, each clip portion extending away from said curling member, each clip portion having a concave surface facing another clip portion, said hair clip defining a notch between said pair of clip portions, said notch extending away from said handle, said hair clip being configured for containing an end of the dreadlock within said notch, thereby securing the end of the dreadlock to the curling member;

a plurality of grips, said plurality of grips being positioned across said outer surface of said outer wall of said curling member, each said grip extending from said curling member, each said grip tapering away from said curling member to an associated point, each said grip being constructed of a flexible and resilient material, each said grip being configured for pulling the dreadlock when the dreadlock is wrapped around the curling member and said curling member rotates, thereby facilitating the curling of the dreadlock;

an aperture, said aperture extending through said distal end of said curling member to said hollow space;

a rod, said rod being rotationally coupled to said handle, said rod extending through said aperture and said hollow space, said rod having a cap portion, said cap portion being positioned in abutment with said curling member at said distal end of said curling member, thereby securing said curling member to said rod;

a plurality of reservoir moisture sensors, said plurality of reservoir moisture sensors being positioned around said distal end of said perimeter wall portion of said moisture reservoir, each said reservoir moisture sensor being configured for sensing a presence of a quantity of moisture at said distal end of said perimeter wall portion of said moisture reservoir, said plurality of reservoir moisture sensors being operationally coupled to each of said motor, said pair of drying coils, and said vaporizing coil, said plurality of reservoir moisture sensors being configured for deactivating each of said motor, said pair of drying coils, and said vaporizing coil when said plurality of reservoir moisture sensors sense the presence of the quantity of moisture;

a light signal emitter, said light signal emitter being positioned partially within said interior space and coupled to said handle, said light signal emitter being operationally coupled to said plurality of hair moisture sensors, said light signal emitter being configured for generating a wet light signal when said plurality of hair moisture sensors sense the presence of the quantity of moisture, said light signal emitter being configured for generating a dry light signal when said plurality of hair moisture sensors do not sense the presence of the quantity of moisture, said light signal emitter being operationally coupled to said plurality of reservoir moisture sensors, said light signal emitter being configured for generating a full reservoir light signal when said plurality of reservoir moisture sensors sense the presence of the quantity of moisture;

a power cord, said power cord being coupled to and extending from said second end of said handle, said power cord being electrically coupled to each of said plurality of hair moisture sensors, said plurality of reservoir moisture sensors, and said light signal emitter, said power cord being selectively electrically couplable to each of said motor, said pair of drying coils, and said vaporizing coil, said power cord being configured for electrically coupling to an electrical a pair of shrouds, said pair of shrouds being coupled to and extending from said first end of said handle, each said shroud having a distal end relative to said handle, each said shroud diverging from each other shroud from said handle to said distal end of each said shroud, each said shroud having a concave surface, said concave surface of each said shroud facing said curling member;

a motor, said motor being operationally coupled to said rod such that said motor selectively rotates said rod relative to said handle, said motor being positioned within said interior space;

a gear box, said gear box being positioned within said interior space and between said motor and said rod, said gear box operationally coupling said motor to said rod;

a pair of drying coils, each said drying coil being positioned between said rod and said curling member, said pair of drying coils being configured for selectively converting an electrical power into a drying coil heat, thereby drying the dreadlock when the dreadlock is wrapped around said curling member;

a vaporizing coil, said vaporizing coil being positioned within said hollow space along said outer wall of said curling member at said proximal end of said curling member, said vaporizing coil being configured for selectively converting the electrical power into a vaporizing coil heat, thereby vaporizing the quantity of water within said cavity;

a plurality of hair moisture sensors, said plurality of hair moisture sensors being positioned around said outer surface of said outer wall of said curling member, each said hair moisture sensor being configured for sensing a presence of a quantity of moisture in the dreadlock when the dreadlock is wrapped around the curling member;

power source; a curling control button, said curling control button being positioned on and coupled to said outer surface of said handle, said curling control button being operationally coupled to said motor, said curling control button being depressible, said curling control button electrically coupling said motor to said power cord when depressed, thereby activating said motor; and a heating control button, said heating control button being positioned on and coupled to said outer surface of said handle proximate said curling control button, said heating control button being operationally coupled to each of said pair of drying coils and said vaporizing coil, said heating control button being depressible, said heating control button electrically coupling each of said pair of drying coils and said vaporizing coil to said power cord when depressed, thereby activating each of said pair of drying coils and said vaporizing coil.

* * * * *